United States Patent [19]

Zore

[11] 4,341,339

[45] Jul. 27, 1982

[54] HOLLOW WALL TRAY AND COVER CLOSURE LOCK ARRANGEMENT

[75] Inventor: Frank E. Zore, Richmond Heights, Ohio

[73] Assignee: Container Corporation of America, Chicago, Ill.

[21] Appl. No.: 247,393

[22] Filed: Mar. 25, 1981

[51] Int. Cl.[3] ..... B65D 5/20; B65D 5/66; B65D 5/68

[52] U.S. Cl. ..... 229/34 HW; 229/45 R

[58] Field of Search ..... 229/34 HW, 44 R, 45 R

[56] References Cited

U.S. PATENT DOCUMENTS

| | | | |
|---|---|---|---|
| 2,308,818 | 1/1943 | Levhoff | 229/34 HW |
| 2,628,012 | 2/1953 | Goldschall | 229/34 HW |
| 2,839,236 | 6/1958 | Dunning | 229/45 |
| 2,983,428 | 5/1961 | Bess | 229/34 HW |
| 3,403,838 | 10/1968 | Van Dyke | 229/34 HW |
| 3,987,957 | 10/1976 | Johnson | 229/31 FS |

*Primary Examiner*—Herbert F. Ross

*Attorney, Agent, or Firm*—Richard W. Carpenter; Davis Chin

[57] ABSTRACT

A closure arrangement for a hollow wall tray including a lid hinged to the rear wall and having depending therefrom a flange engagable with the inside of the front wall of the tray.

7 Claims, 5 Drawing Figures

HOLLOW WALL TRAY AND COVER CLOSURE LOCK ARRANGEMENT

BACKGROUND OF THE INVENTION

1. Field Of The Invention

This invention relates generally to folding cartons and more particularly to a closure arrangement for a hollow wall tray having an integral cover.

2. Description Of The Prior Art

A state of the art search directed to the subject matter of this application uncovered the following U.S. Pat. Nos. 1,081,068; 1,211,223; 1,530,644; 1,787,498; 2,308,818; 2,321,145; 2,331,754; 2,373,977; 2,447,243; 2,581,400; 2,614,746; 2,668,654; 2,687,839; 2,714,483; 2,839,236; 2,866,587; 2,983,428; 3,095,137; 3,100,074; 3,404,829; 3,744,705, 3,924,801; 4,034,908; 4,040,559; 4,042,166.

None of the prior art patents uncovered in the search disclose a hollow wall tray having the unique locking arrangement with the cover flange that is disclosed and claimed in the present invention.

SUMMARY OF THE INVENTION

It is an object of the invention to provide a hollow wall tray and integral cover formed from an unitary blank of foldable paperboard which has a positive locking arrangement between the tray front wall and the cover.

A more specific object of the invention is the provision of locking tabs extending from the upper portion of the tray front wall for receipt within apertures of a flange formed integrally with and depending from the cover top wall.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 5:
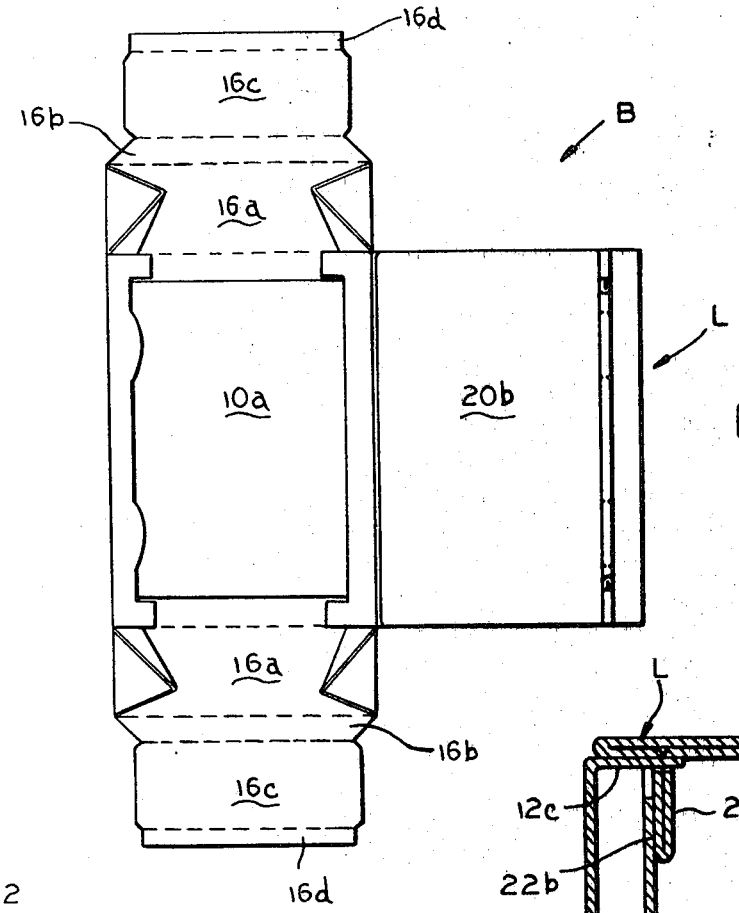
FIG. 5 is a plan view of the blank illustrated in FIG. 4, but after certain elements have been folded in position to begin forming carton structure.
Figure 3:
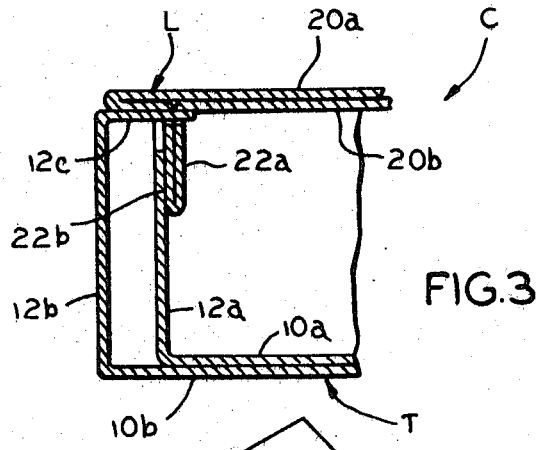
FIG. 3 is a fragmentary vertical section taken on line 3—3 of FIG. 2.
Figure 1:
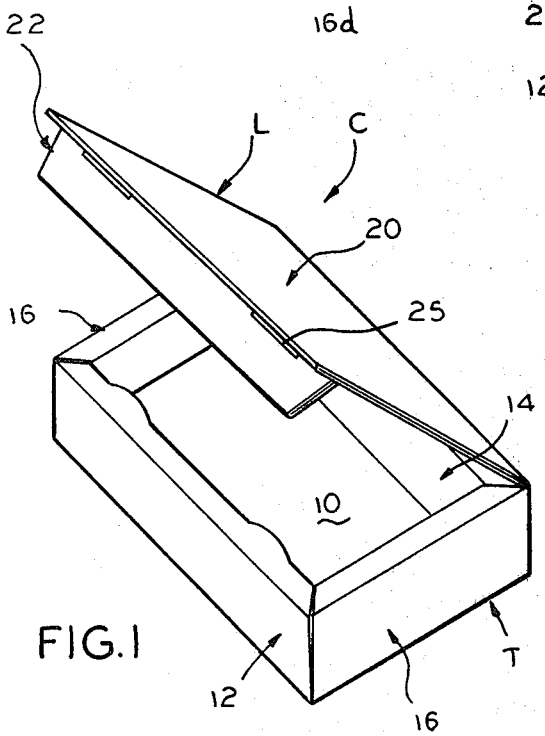
FIG. 1 is a perspective view of an integral tray and cover embodying features of the invention and shown in the open position.
Figure 2:
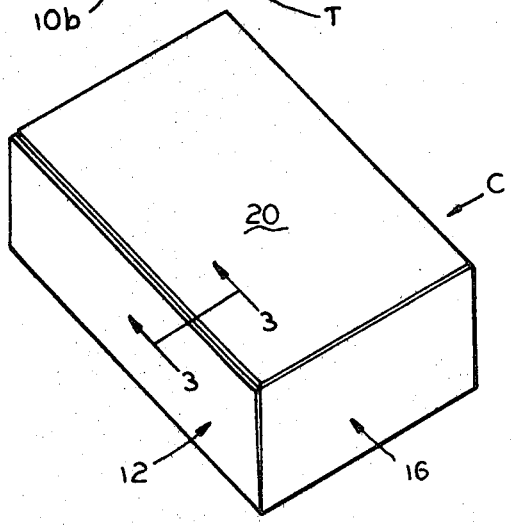
FIG. 2 is a perspective view of the structure illustrated in FIG. 1, but with the cover shown in the closed position.
Figure 4:
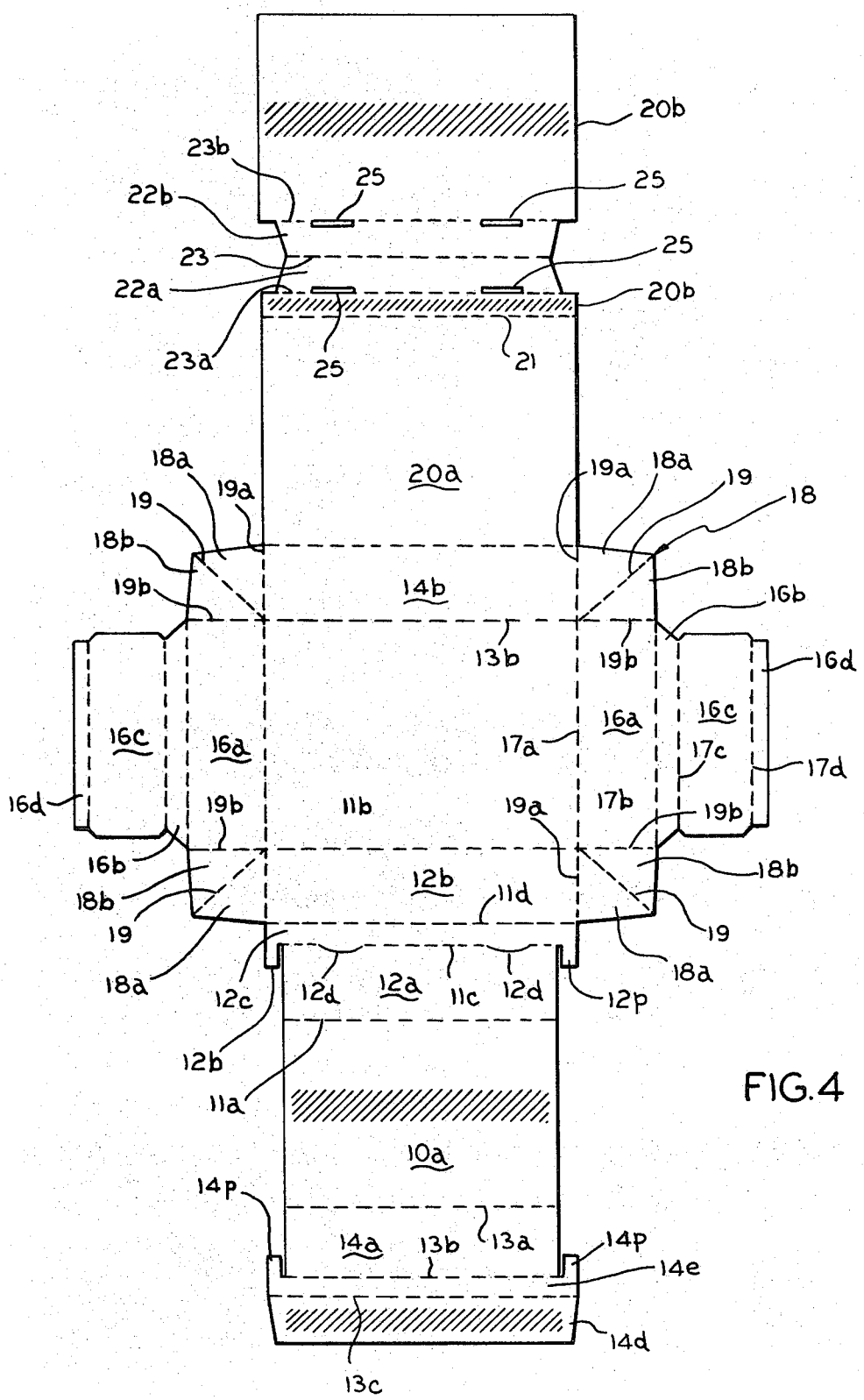
FIG. 4 is a plan view of a blank of foldable sheet material from the carton illustrated in the other views may be formed.

Referring now to the drawings for a better understanding of the invention, it will be seen that the carton indicated generally at C and illustrated in FIGS. 1 through 3 includes integral tray and lid members T and L, respectively, and may be formed from the unitary blank B of foldable sheet material, such as paperboard, illustrated in FIGS. 4 and 5.

Tray member T includes a bottom wall 10 having opposed front and rear side walls 12 and 14 and end walls 16 upstanding therefrom and foldably connected thereto and to each other to form a box-like structure open at the top. The side and end walls are interconnected by means of gusset members 18 in a manner hereinafter described.

Cover or lid member L includes a top wall 20 having an integral flange 22 secured thereto and depending therefrom at a location spaced inwardly from the front edge thereof.

As best seen in FIG. 3 bottom wall 10 of tray member T includes a pair of inner and outer panels **10*a* and 10*b* which are secured to each other in face-to-face relation with their forward edges being foldably joined along fold lines 11*a* and 11*b* to the lower edges of front wall inner and outer panels 12*a* and 12*b***, respectively.

The upper edges of front wall inner and outer panels **12*a* and 12*b* are joined to each other by a relatively narrow elongated upper or connecting panel 12*c* which is foldably joined at its inner and outer edges along fold lines 11*c* and 11*d* to the upper edges of inner and outer panels 12*a* and 12*b*, respectively. It will be noted that the forward edge of connecting panel 12*c* is provided with at least one if not more projections or locking tabs 12*d* the purpose of which is described later in the specification. Rear side wall 14 is also a hollow wall and comprises an inner panel 14*a* which is foldably joined at its lower edge along a fold line 13*a* to the rear edge of bottom wall inner panel 10*a*; an upper or connecting panel 14*c* which is foldably joined at its inner edge along fold line 13*b* to the upper edge of inner panel 14*a*; an intermediate panel 14*d* which is foldably joined at its upper edge along fold line 13*c* to the outer edge of upper panel 14*c*; and an outer panel 14*b* which is foldably joined at its lower edge along a fold line 13*d* to the rear edge of bottom wall outer panel 10*b***.

Each of the end walls 16 are also hollow walls and each comprises an outer panel **16*a* foldably joined at its lower edge along fold lines 17*a* to an end edge of bottom wall outer panel 10*b*; an upper or connecting panel 16*b* foldably joined at its outer edge along fold lines 17*b* to the upper edge of outer panel 16*a*; an inner panel 16*c* foldably joined at its upper edge along fold lines 17*c* to the inner edge of upper panel 16*b*; and a lower or retaining panel 16*d* foldably joined at its inner edge along fold lines 17*d* to the lower edge of inner panel 16*c*. Retaining panel 17*d* may be adhesively secured to the inner face of bottom wall inner panel 10*a* inwardly of inner panel 16*c* or it may be folded outwardly so as to lie between inner and outer panels of the end wall in face-to-face relation with the upper surface of bottom wall inner panel 10*a*. As mentioned earlier each of the end walls 16 is connected to both of the front and rear side walls 12 and 14 by gusset elements 18 each of which includes a pair of generally triangular gusset sections 18*a* and 18*b* which are foldably joined to each other along a diagonal fold 19 and which are foldably joined to the adjacent end edges of the side wall outer panels on fold lines 19*a* and which are foldably joined to the adjacent side edges of related end wall outer panels along fold lines 19*b***.

As best seen in FIG. 1 and also in FIG. 5 the front and rear wall upper panels **12*c* and 14*c* may be provided with projections 12*p* and 14*p*, respectively, disposed to extend under the end wall upper panels 16*b***.

Also it will be noted that in the formation of the tray portion of the carton the sections of each of the gussets 18 are folded against each other in face-to-face relation and against the related side wall of the tray so as to be interposed between the inner and outer panels of the front and rear side walls of the tray. In the case of the rear side wall of the tray intermediate panel 14*d* may be adhesively secured to the inner surface of rear wall outer panel 14*b*.

Now to describe the cover or lid portion L of the carton. The cover portion includes an outer panel 20*a* and inner panel 20*b* which are joined to each other at their outer edges along fold line 21 and folded and secured together in face-to-face relation. It will be noted that inner panel 20*b* has two sections that are separated from each other by the previously referred to locking flange 22. Flange 22 includes a pair of outer and inner flange sections 22*a* and 22*b* which are foldably joined to each other at their lower edges on fold line 23 and which are foldably joined along their upper edges on fold lines 23*a* and 23*b* to the adjacent edges of the top wall inner panel 20*b*.

It will also be noted that the flange panels are provided with apertures 25 which are disposed in alignment with the lock tabs 12*a* on the tray front wall upper panel so that when the lid is in closed position, as illustrated in FIG. 3, the lock tabs will be received within the apertures to form a positive locking connection between the tray and cover members.

I claim:

1. In a closure lock arrangement for a hollow wall tray and an integral hinged cover, formed of a unitary blank of foldable paperboard, the combination of:

(a) a tray member including a bottom wall having opposed hollow front and rear side walls and hollow end walls upstanding therefrom and foldably joined thereto and to each other to form a box-like enclosure open at the top;

(b) said hollow front side wall comprising a pair of inner and outer panels spaced from each other and having upper edges imterconnected by a relatively narrow connecting panel which has at least one integral lock tab projecting inwardly from the inner edge thereof;

(c) a cover member including a top wall hingedly attached at its rear edge to an upper edge of said rear side wall and having a locking flange extending downwardly from a front portion thereof;

(d) said flange being spaced inwardly from the front edge of said top wall and being substantially the thickness of said front wall and presenting at least one aperture aligned with said tray member lock tab for receipt thereof when a marginal portion of said cover top wall is seated on said tray member front wall upper connecting panel.

2. An arrangement according to claim 1 wherein all of said side and end walls are hollow and include upper panels which cooperate to present a common co-planar surface for engaging and supporting peripheral portions of said cover top wall.

3. An arrangement according to claim 1, wherein said cover member top wall is two-ply and includes a pair of inner and outer panels, secured to each other in face-to-face relation.

4. An arrangement according to claim 3, wherein said top wall inner panel includes a pair of co-planar sections separated from each other by said locking flange.

5. An arrangement according to claim 4, wherein said locking flange includes a pair of panels foldably joined to adjacent edges of said top wall inner panel sections and to each other on parallel fold lines.

6. An arrangement according to claim 1, wherein said locking flange includes a pair of relatively narrow, elongated panels foldably joined to said top wall and to each other.

7. In a closure lock arrangement for a hollow wall tray and an integral hinged cover, formed of a unitary blank of foldable paperboard, the combination of:

(a) a tray member including a bottom wall having opposed hollow front and rear side walls and hollow end walls upstanding therefrom and foldably joined thereto and to each other to form a box-like enclosure open at the top;

(b) said hollow front side wall comprising a pair of inner and outer panels and having at least one integral lock tab projecting inwardly from said inner panel;

(c) a cover member including a top wall hingedly attached at its rear edge to an upper portion of said rear side wall and having a locking flange extending downwardly from a front portion thereof;

(d) said flange being spaced inwardly from the front edge of said top wall a distance substantially equal to the thickness of said front wall and presenting at least one aperture aligned with said tray member lock tab for receipt thereof when a marginal portion of said cover top wall is seated on said tray member front wall.

* * * * *